United States Patent [19]

McGeehee

[11] Patent Number: 4,462,759

[45] Date of Patent: Jul. 31, 1984

[54] OIL WELL PUMP SHUTDOWN SYSTEM

[75] Inventor: Ronald W. McGeehee, Redwood Valley, Calif.

[73] Assignee: All American University, Incorporated, Upland, Calif.

[21] Appl. No.: 335,897

[22] Filed: Dec. 30, 1981

[51] Int. Cl.[3] ..... F04B 49/00

[52] U.S. Cl. ..... 417/46; 60/372; 60/379; 417/399

[58] Field of Search ..... 417/1, 44, 46, 398, 417/399; 60/403, 414, 417, 372, 381, 379; 91/218; 74/589

[56] References Cited

U.S. PATENT DOCUMENTS

| | | | |
|---|---|---|---|
| 2,577,479 | 12/1951 | Owen et al. | 417/1 X |
| 3,306,210 | 2/1967 | Boyd et al. | 417/1 |
| 3,369,490 | 2/1968 | Hawk | 60/372 X |
| 3,632,234 | 1/1972 | Lake | 417/399 X |
| 3,782,117 | 1/1974 | James | 60/372 |

*Primary Examiner*—Edward K. Look

*Attorney, Agent, or Firm*—Townsend and Townsend

[57] ABSTRACT

An emergency shutdown system for an air-balanced pumping unit which includes a pump motor, a walking beam driven by the pump motor, a rod string reciprocated by the beam, and an air-balance cylinder and an air receiver which together define an air spring for storing energy from the beam is disclosed. A lever arm is pivotally mounted on the walking beam and attached at one end to the rod string so that a rotational moment is exerted in proportion to the weight of the rod string. Such rotational moment is opposed by an air bag, the output force of the air bag being adjustable within the expected range of the rotational moment. Thus, by properly adjusting the air bag, loss of load on the rod string results in movement of the lever arm. A shutdown valve is operatively connected to the lever arm and bleeds air from the air cylinder upon loss of load.

10 Claims, 4 Drawing Figures

OIL WELL PUMP SHUTDOWN SYSTEM

BACKGROUND OF THE INVENTION

The present invention relates generally to oil well pumping units, and more particularly to an emergency system for shutting down operation of the pumping unit after a sudden loss of pumping load.

Air-balanced pumping units have been used for pumping oil from wells for many years. Such pumping units include a frame, a walking beam reciprocably mounted on the frame, a barrel pump located underground in proximity to the oil bearing formation, and a sucker rod assembly operably connecting the walking beam with the barrel pump. A pump motor, which can be electric, diesel, steam-driven or the like, reciprocates the walking beam to drive the barrel pump. An air cylinder is connected to the walking beam near its output end and is pneumatically connected to an air receiver so that energy is stored in the cylinder in the form of compressed air as the walking beam travels downward. Acting as an air spring, the cylinder returns energy to the walking beam on its upward stroke. Such air-balanced pumping units enjoy widespread use in the oil fields and have proven to be both reliable and economic in operation.

Although generally reliable, the sucker rod assemblies of such units occasionally fail due to fatigue and over stressing resulting from substantially continuous operation, sometimes over a period of years. If such failure occurs near the upper end of the sucker rod string, or at the polish rod which connects the sucker rod to the walking beam, the result is an immediate cessation of load on the pumping unit. When such loss of load occurs, the energy stored in the air cylinder and air receiver can exert a large unbalanced upward force, often exceeding 25,000 lbs, on the walking beam often can result in catastrophic failure of the unit and potential injury to nearby persons and property.

It is therefore desirable to provide a shutdown system for air-balanced pumping units which can sense a loss of load on the pump, release stored energy in the air cylinder and air receiver system, and halt pump operation with minimum stress placed on the unit.

SUMMARY OF THE INVENTION

The present invention provides a system for shutting down an air-balanced oil well pumping unit when load on the unit is suddenly lost, typically because of failure of the sucker rod. The system mechanically senses a loss of load in the rod string assembly (including the polish rod and polish cable) and, when such loss occurs, bleeds air pressure from the air cylinder and air receiver so that energy is not returned to the "unbalanced" walking beam. While the system is entirely mechanical and enjoys the reliability associated with mechanical systems, it displays a very rapid response to ensure that energy is drained from the cylinder before damage can be done.

The shut-down system includes means for mechanically sensing the load on the pump and for generating mechanical (force) output which is proportional to the measured load. An actuator also supplies a mechanical (force) output, said actuator force being opposed to the force proportional to the load. The actuator force is adjustable and a mechanical detector senses when the actuator force exceeds the load force. Thus, by selecting an actuator force which is some fraction, typically 25%, of the minimum dynamic load on the pump, the detector will respond to sudden reductions in pumping load. When such an event occurs, the detector will shutdown the pump operation.

In the preferred embodiment, a lever arm is pivotally attached to the horsehead of a pumping unit. One end of the lever arm is attached to the polish cable, and the force on the cable (which is equal to the load exerted by the polish rod and sucker rod string) urges the lever arm to rotate in one direction. The actuator comprises a pneumatic cylinder, or air bag, which is connected to the lever arm so as to rotate said lever arm in the opposite direction. The force exerted by the actuator can be adjusted, and by adjusting the force to an amount less than the minimum dynamic load on the pumping unit, the lever arm will remain in a first position at all times. However, when a substantial portion of the load of pumping unit is lost, the force exerted by the actuator will overcome the force exerted by the polish cable, and the lever arm will rotate to a second position.

A shutdown valve is operably connected to the lever arm, and a shift from the first to the second position causes the shutdown valve to bleed air from the air cylinder, thus preventing the stored energy in the system from returning to the pumping unit. Additionally, a switch which controls the pump motor operation is connected to the lever arm so that the pump motor is simultaneously shutdown.

The novel features which are characteristic of the shutdown system, as to organization and method of operation, together with further objects and advantages, thereof will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DESCRIPTION OF THE PREFERRED EMBODIMENT

Figure 1:
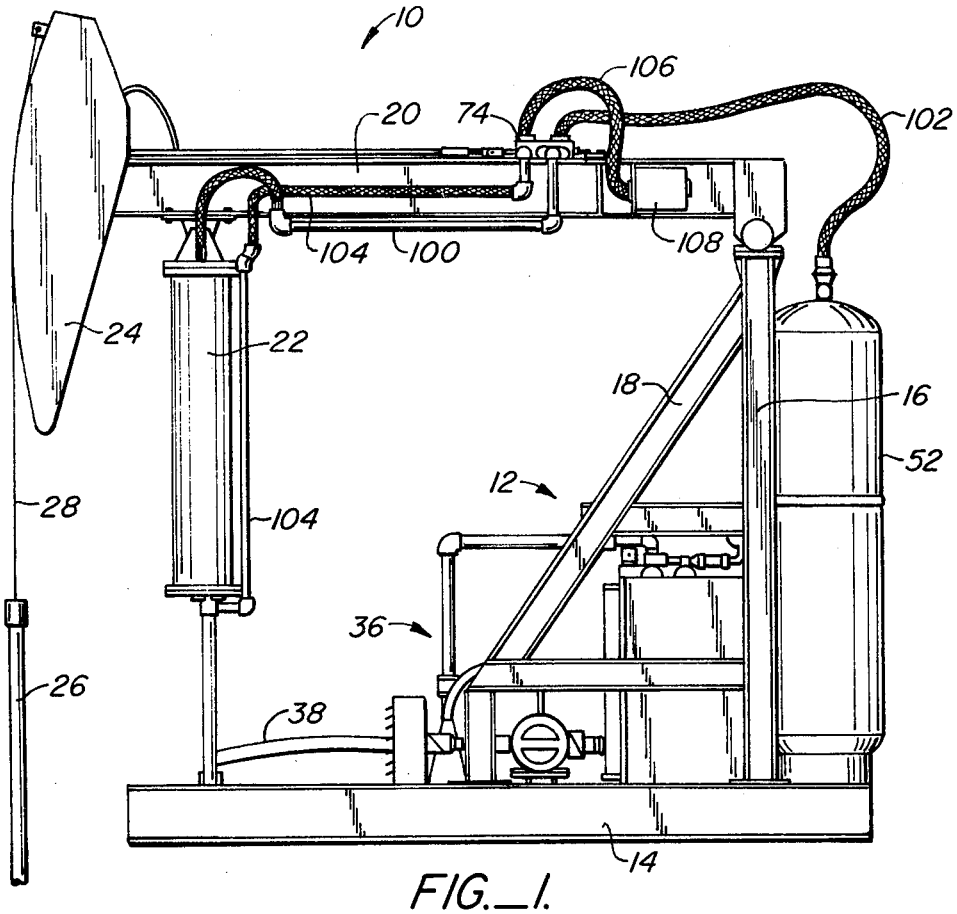
FIG. 1 is a side elevational view of an oil well pumping unit, including the shutdown system of the present invention.
Figure 2:
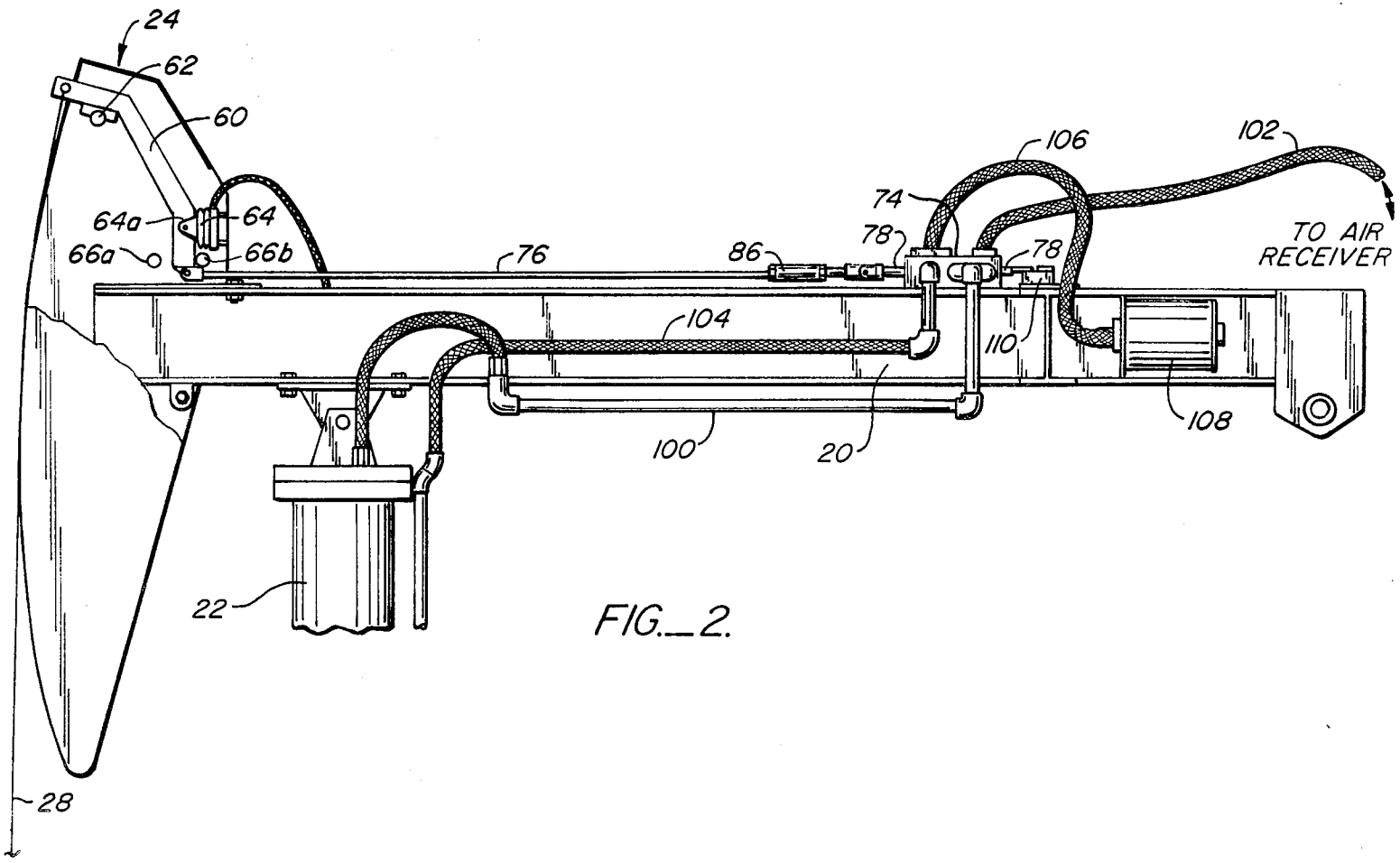
FIG. 2 is a side elevational view of the walking beam and horsehead of the pumping unit of FIG. 1 with portions broken away, illustrating in detail the shutdown system of the present invention.

Referring to FIGS. 1 and 2, an air-balanced pumping unit 10 includes a frame 12 comprising a base 14 and an upright post 16 secured at its lower end to a base and having a brace 18 providing structural support at its upper end.

A walking beam 20 is pivotally secured at its right end (as viewed in FIGS. 1 and 2) to the top of upright post 16. The left end of the walking beam 20 is supported by a cylinder assembly 22, which includes an air-balanced cylinder, described in detail hereinafter. The walking beam 20 terminates at its left end in a horsehead 24 which is operably connected to a polish rod 26 by means of a polish cable 28. Together, the walking beam 20 and horsehead 24 define the walking beam assembly, as referred to hereinafter.

The operation of an oil well pump by a reciprocating walking beam is well known in the art and will not be described in detail. For the purpose of the present invention, it is necessary to point out only that the polish rod is connected to an underground barrel pump by a sucker rod assembly which can be 1000 feet long, or more. Hereinafter, for convenience, the combination of the polish cable, polish rod and sucker rod will be referred to generally as the "rodstring". Failure of the rod string at any point, particularly near its upper end, leads to a sudden and substantial loss of load on the puming unit. The system of the present invention terminates operation of the pumping unit after such failure of the rod string before the stored energy in the air-balanced cylinder can damage the unit.

The walking beam may be reciprocated by a variety of conventional techniques. For example, a gear and pitman assembly can directly drive the walking beam. In the preferred embodiment, the walking beam 20 is hydraulically driven by a hydraulic piston which forms part of the cylinder assembly 22, as will now be described.

A hydraulic system 36 is mounted on the base 14 on the pumping unit 10, as illustrated generally in FIG. 1. The hydraulic system 36 provides hydraulic fluid under pressure to the cylinder assembly 22 through a hydraulic line 38. The system 36 is capable of delivering sufficient pressure to raise the walking beam 20, simultaneously raising the rod string and driving the underground barrel pump. During approximately one half of the pump cycle, the system 36 delivers pressurized hydraulic fluid to the cylinder assembly 22 to raise the walking beam, and during the remainder of the pump cycle the fluid is free to drain back to the hydraulic system under the weight of the rod string, as will be described hereinafter.

Figure 3:
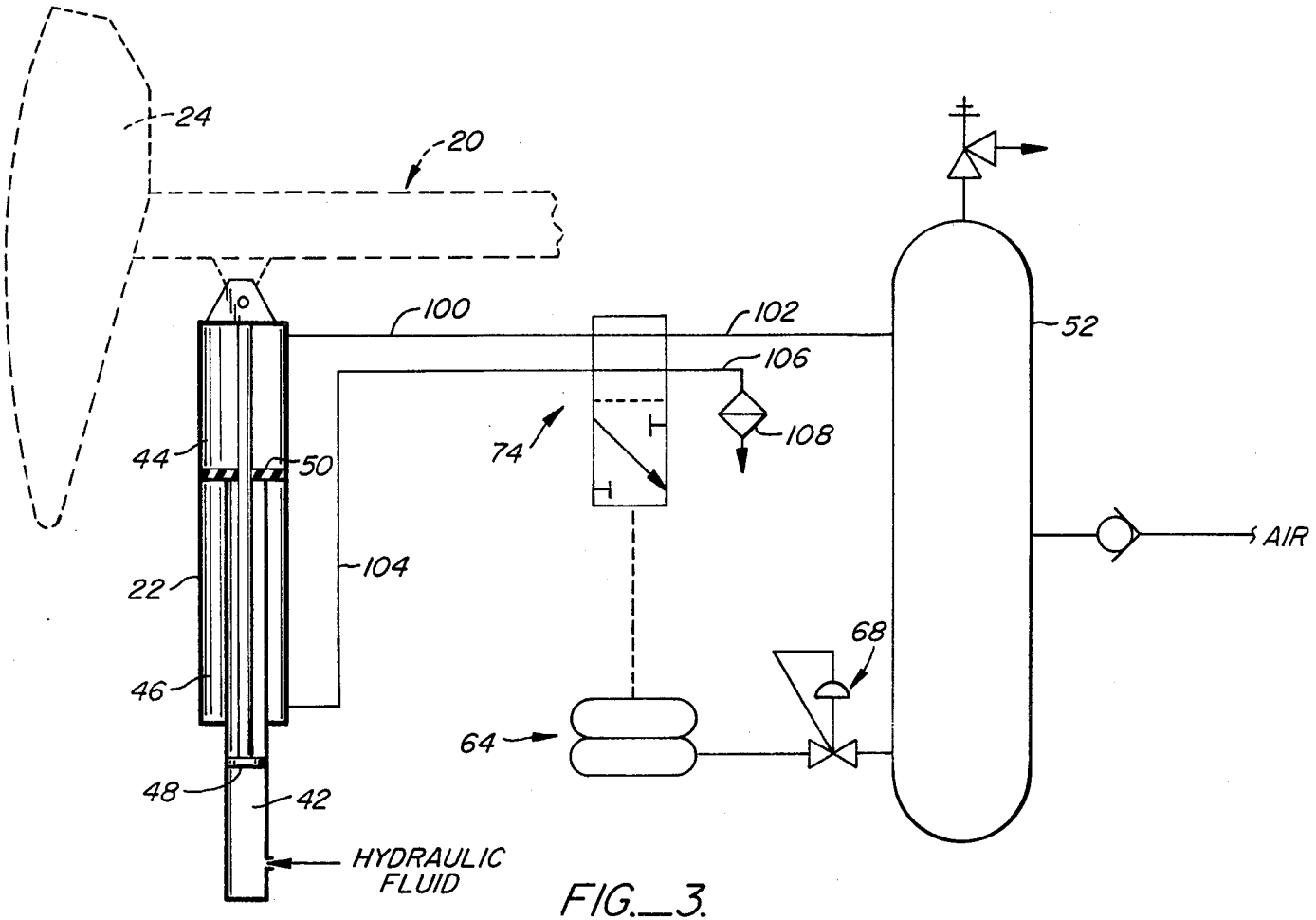
FIG. 3 is a schematic diagram illustrating the hydraulic connections of the present invention.

Referring now in particular to FIG. 3, the cylinder assembly 22 includes three chambers 42, 44 and 46. The first chamber 42 receives the pressurized hydraulic fluid from the hydraulic system 36. The hydraulic fluid acts against piston 48 to raise the cylinder 22 and elevate the walking beam 20. Due to the great weight of the rod string, a very large piston 48 would be required for actuation were it not for the air-balanced cylinder defined by chamber 44. The load on the piston 48, however, is reduced by the ability of piston 50 in chamber 44 to store energy on the downstroke of the walking beam 20 by compressing air into air receiver 52. The compressed air returns to chamber 44 and assists the hydraulic cylinder 42 in raising the cylinder assembly 22 during the upstroke of the walking beam 20.

The relative size of the pistons 48 and 50 depend on the length of walking beam travel, the weight of the rod string, the hydraulic fluid pressure, and the like. The various parameters can be optimized and the cylinder assembly 22 sized according to the particular application.

Thus far, the pumping unit 10 described has been conventional. The novel system which comprises the present invention will now be described in relationship to the pumping unit 10, as described hereinabove. It is to be understood, however, that the emergency shutdown system of the present invention can be applied to virtually any air-balanced oil well pumping unit and is not limited to the particular unit just described. Specifically, the present invention is not limited to a hydraulically driven pumping unit.

Referring now in particular to FIG. 2, the shutdown system of the present invention comprises a lever arm 60 pivotally secured to the horsehead 24 on a pivot pin 62. The left end of the lever arm 60 (as viewed in FIG. 2) is secured to the upper end of the polish cable 28 so that the polish cable exerts a force on the lever arm equal to the combined weight of the polish cable, polish rod, sucker rods, and any dynamic force components arising from the pumping action itself. This downward force exerted on the left end of the lever arm 60 tends to rotate the lever arm in a counterclockwise direction about the pin 62.

An actuator 64, typically an air bag, is mounted on the horsehead 24 adjacent the lower end of the lever arm 60. The output element of the air bag 64 is secured to the lower end of the lever arm 60 so that pressure applied to the air bag exerts a force on the lever arm tending to rotate the lever arm in a clockwise direction.

The forces exerted on the lever arm 60 by both the rod string and the actuator 64 are, of course, governed by well-known mechanical principles. The force exerted by the rod string induces a clockwise rotational moment equal to the magnitude of the force multiplied by the distance from the pivot point 62. An opposite rotational moment is induced by the actuator 64 and equal to the magnitude of the actuator force times the distance over which the force is applied. Thus, the dimensions of the lever arm 60, as well as the magnitudes of the applied forces, will determine which moment is greater.

It is desired that the moment applied by the actuator 64 be adjustable generally within the expected range of the rod string moment. To achieve this, the actuator 64 should be sized based on the dimensions of the lever arm 60 and the expected weight of the rod string. Precise adjustment can be made in the field, typically by adjusting the air pressure to the pneumatic actuator 64, as described hereinafter.

Stop members 66 are provided near the lower end of the lever arm 60 to limit its travel. Thus, when the moment exerted on the lever arm 60 by the polish cable 28 exceeds the moment exerted by the air bag 64, the lower end of the lever arm will rest against stop member **66*b*, as illustrated in FIG. 2. When the moment exerted by the air bag 64 exceeds that exerted by the polish cable 28, however, the lever arm 60 will shift and the lower end will rest against stop member 66*a*. Thus, the lever arm 60 and the air bag 64** define a mechanical system for sensing the cessation of load on the rod string.

The sensitivity (i.e., the magnitude of load loss which will be detected) of the mechanical sensing system just described can be adjusted by changing the force exerted by the air bag 64, which in turn is varied by a pressure regulating valve 68 (FIG. 3). The force is chosen so that the moment exerted by the air bag 64 is some fraction of the moment exerted by the rod string.

If the rod string breaks, the clockwise moment on lever arm 60 will be diminished by an amount related to the location of the break. That is, if the rod string breaks at a very deep location, the weight of the rod string will be diminished only a small amount. In contrast, if the rod string breaks very near the top, the weight of the rod string will be reduced to an amount close to zero. By increasing the force exerted by the air bag 64, the clockwise moment exerted by the rod string is more readily overcome, allowing detection of even a minor decrease in load. A lower force exerted by the air bag 64 will respond only to more substantial losses of load. Typically, the shutdown system will be adjusted in the less sensitive range so that minor fluctuations in the dynamic load encountered during normal operation will not trigger a system shutdown.

A shutdown valve 74 is mounted on the walking beam 20 and operably connected to the lower end of the lever arm 60 by a rod 76. Clockwise rotation of the lever arm 60 shifts the position of rod spool 78 (best illustrated in FIG. 4) in valve 74 to the left as viewed in FIG. 2, bleeding air from the air chamber 44 of the cylinder assembly 22, as described in more detail hereinafter. A variable-length segment 86 in the rod 76 allows precise adjustment of the valve spool 78 position within the shutdown valve 74.

Figure 4:
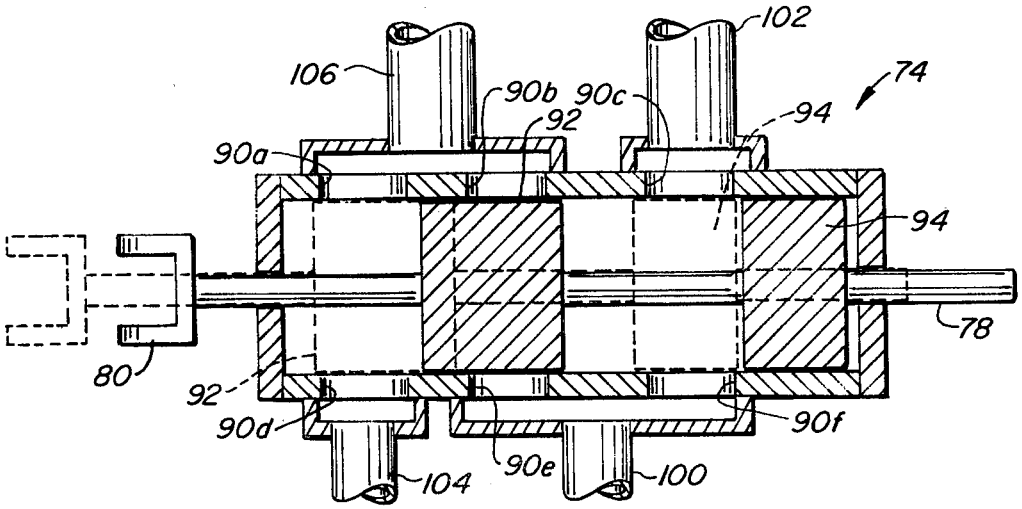
FIG. 4 is a sectional view illustrating the shutdown valve of the present invention.

Referring now to FIG. 4, the shutdown valve 74 comprises a valve body 88 having six ports 90 therethrough. The ports 90 are transversely aligned so that plugs 92 and 94 can, depending on the position of the valve spool 78, block flow between aligned pairs of port. Specifically, in a first position (shown in full line), flow between ports 90*a* and 90*d* and ports 90*c* and 90*f* is permitted, while flow between ports 90*b* and 90*e* is blocked. This position corresponds to the normal operating position with the valve spool 78 shifted fully rightward. The with valve spool 78 shifted to the left (as shown in phantom in FIG. 4) plug 94 moves to block the passage between ports 90*c* and 90*f*, and plug 92 moves to block the passage between the ports 90*a* and 90*d*. Simultaneously, the passage between ports 90*b* and 90*e* is opened.

Referring now also to FIG. 3, line 100 connects chamber 44 of cylinder 22 to shutdown valve 74. Line 102 connects valve 74 to the air receiver 52. Line 100 is manifolded to both ports 90*e* and 90*f*, while line 102 communicates only with port 90*c*. Thus, when the valve spool 78 is in its normal (rightward) position, chamber 44 will be in direct fluid communication with air receiver 52. Chamber 44 and receiver 52 together define an air spring where the receiver is pressurized on the downstroke of walking beam 20. The energy thus stored as compressed air is returned to the walking beam during the upstroke.

Lower air chamber 46 of cylinder 22 is connected by line 104 to port 90*d* of shutdown valve 74. Ports 90*a* and 90*b* are manifolded and directed by line 106 to an air filter 108 for bleeding into the atmosphere. With valve 78 in its normal position, chamber 46 communicates directly with filter 108 through ports 90*d* and 90*a*. This allows chamber 46 to draw air on the upstroke of walking beam 20 and expel air to the atmosphere on the downstroke.

When valve spool 78 is shift to the left to shutdown the pumping unit 10 the passage 90*c*–90*f* is blocked to prevent return air flow to chamber 44 from air receiver 52. Passage 90*b*–90*e* is opened to bleed the air in chamber 44 through line 106 and filter 108 to atmosphere. Additionally, passage 90*a*–90*d* is blocked by plug 92 and whatever air is in chamber 46 is trapped. The trapped air acts to cushion the downstroke of the walking beam 20, although the present invention would function even if chamber 46 were vented to the atmosphere.

The rightward end of valve spool 78 is connected to a switch 110, as shown in FIG. 2. The switch is connected to the hydraulic system 36 so that the hydraulic system 36 becomes inoperative to drive the pump motor during the shutdown of pumping unit 10. In the case of steam or internal combustion motors, the switch 10 will control a suitable relay device to effect shutdown of the steam or internal combustion motor.

While a preferred embodiment of the present invention is illustrated in detail, it is apparent that modification and adaptations of that embodiment will occur to those skilled in the art. However, it is to be expressly understood that such modifications and adaptations are within the spirit and scope of the present invention, as set forth in the following claims.

What is claimed is:

1. In an oil well pumping unit including a pump motor, a walking beam assembly driven by the pump motor, a rod string reciprocated by the beam assembly, and an air-balanced cylinder for storing energy from the beam during a portion of the pump cycle and returning energy to the beam during the remainder of the cycle, a shutdown system comprising:

means for mechanically sensing the load exerted by the rod string, said means having a force output proportional to said load;

means for applying a preselected force in opposition to the force output of the sensing means; and means for detecting when said opposing force exceeds said output force and for stopping the operation of the pump motor and means for bleeding the air-balanced cylinder when such an event occurs so that motion of the walking beam will cease substantially immediately.

2. In an oil well pumping unit including a pump motor, a walking beam assembly driven by the pump motor, a rod string reciprocated by the beam assembly, and an air-balance cylinder for storing energy from the beam during a portion of the pump cycle and returning energy to the beam during the remainder of the cycle, a shutdown system comprising:

a lever arm pivotally secured to the walking beam assembly and coupled to the rod string in such a manner that a rotational moment is induced in said lever arm by the weight of said rod string;

an actuator having a force output coupled to the lever arm to apply an opposite rotational moment thereto;

a shutdown valve fluidly connected to the air balance cylinder; and means for operating the shutdown valve in response to the position of the lever arm, whereby said shutdown valve prevents the return of energy to the beam when the moment induced by the actuator exceeds that applied by the rod string.

3. A shutdown system as in claim 2, wherein the shutdown valve is coupled to the lever arm by a rod.

4. A shutdown system as in claim 2, wherein the shutdown system further includes a switch means for stopping the operation of the pump motor, said switch being coupled to the lever arm.

5. In an oil well pumping unit including a pump motor, a walking beam assembly driven by the pump motor, a rod string reciprocated by the beam assembly, and an air-balanced cylinder for storing energy from the beam during a portion of the pump cycle and returning energy to the beam during the remainder of the cycle, a shutdown system comprising:

a lever arm pivotally mounted on the walking beam assembly and connected to the rod string so that the rod string applies a force which urges the arm to rotate in one direction;

means for applying a preselected force to the lever arm, which preselected force urges the lever arm to rotate in the opposite direction; and means responsive to the position of the lever arm for bleeding the air-balanced cylinder when the preselected force exceeds the force exerted by the rod string.

6. A shutdown system as in claim 5, wherein the means for opposing the force output of the sensing means is a pneumatic actuator having an output connected to urge rotation of the lever arm in the opposite direction.

7. A shutdown system as in claim 6, wherein the pneumatic actuator is connected to a variable pressure source so that the output force of the actuator can be adjusted.

8. A shutdown system as in claim 6, wherein the means for detecting and shutting down includes a shutdown valve actuated by the arm so that pressure in the air spring is relieved so that energy will not be returned to the walking beam.

9. A shutdown system as in claim 8, wherein the means for detecting and shuttingdown further includes a switch for disengaging the pump motor, said switch being actuated by the lever arm.

10. A shutdown system as in claim 8 or 9, wherein the lever arm is coupled to the means for detecting and shutting down by a rod.

* * * * *